US012692712B2

(12) United States Patent
Miranda

(10) Patent No.: US 12,692,712 B2
(45) Date of Patent: Jul. 28, 2026

(54) SEAL PLATE

(71) Applicant: Luis A. Miranda, Mission, TX (US)

(72) Inventor: Luis A. Miranda, Mission, TX (US)

( * ) Notice: Subject to any disclaimer, the term of this patent is extended or adjusted under 35 U.S.C. 154(b) by 437 days.

(21) Appl. No.: 18/358,549

(22) Filed: Jul. 25, 2023

(65) Prior Publication Data

US 2024/0344338 A1 Oct. 17, 2024

Related U.S. Application Data

(63) Continuation-in-part of application No. 29/874,693, filed on Apr. 24, 2023.

(60) Provisional application No. 63/496,047, filed on Apr. 14, 2023.

(51) Int. Cl.
*E04G 5/00* (2006.01)
*E04G 7/28* (2006.01)

(52) U.S. Cl.
CPC ..... *E04G 5/001* (2013.01); *E04G 7/28* (2013.01)

(58) Field of Classification Search
CPC ..... E04G 7/06; E04G 7/28; E04G 5/001
See application file for complete search history.

(56) References Cited

U.S. PATENT DOCUMENTS

| | | | | |
|---|---|---|---|---|
| 660,174 | A * | 10/1900 | Tischer | A47L 3/02 182/59 |
| 1,836,126 | A * | 12/1931 | Luce | A47B 57/26 108/42 |
| 4,445,591 | A * | 5/1984 | Mitchell | A01M 31/02 182/187 |
| 11,142,925 | B2 | 10/2021 | Francis | |
| 11,317,716 | B2 | 5/2022 | Martin et al. | |
| 11,718,426 | B1 * | 8/2023 | Duschl | B64G 5/00 244/171.6 |
| 2006/0225960 | A1 | 10/2006 | Ferlin et al. | |
| 2013/0098709 | A1 * | 4/2013 | Miller | E04G 3/243 182/83 |
| 2016/0186450 | A1 * | 6/2016 | Watson | E04G 7/302 182/222 |

* cited by examiner

*Primary Examiner* — Daniel J Troy

(57) ABSTRACT

A seal plate assembly designed to quickly install and fully cover floor openings on a scaffold deck. The present invention includes at least one plate A and at least one bracket. The at least one plate A covers the floor opening, and the at least one bracket removably attaches the at least one plate A to the scaffold deck. Each plate A includes a slotted aperture designed to attach to the top of a bracket. This arrangement makes it easy to install, as the user simply slides the top of the bracket across the slotted aperture and connects the bottom of the bracket to a structural support, all without having to reach underneath and hold the bracket in place. In another embodiment, the present invention further includes a pair of plates B that are uniquely assembled to cover a remaining gap surrounding a fixed structure passing through the scaffold deck.

14 Claims, 14 Drawing Sheets

SEAL PLATE

FIELD OF THE INVENTION

The present invention relates generally to hole covers. More specifically, the present invention is a scaffold seal plate capable of covering and sealing off all floor openings on a scaffold deck.

BACKGROUND OF THE INVENTION

Scaffolding is commonly used during construction and maintenance of any elevated structure. In general, a scaffold is a temporary platform that can be elevated to a certain height and is capable of supporting workers and materials. Scaffolding is needed in pretty much anything that has elevated structures or places where a man-lift or scissor lift can fit in. In large open spaces, a scaffold can be built relatively quickly using standard parts and equipment. In contrast, building a full scaffold deck in congested areas such as refineries, nuclear plants, and power plants can be extremely complicated due to the difficult working conditions. In these environments, the scaffold deck may be exposed to hot/cold areas, contaminated areas such as Alkylation, units where HF acid is present, or radiation areas that are highly contaminated.

When a scaffold builder encounters a pipe, metal structure, or any object that is in the center of a scaffold, the scaffold lead builds a scaffold frame around the structure or object, and proceeds to lay down metal boards where the platforms will be needed for other contractors to work. Then, a 2"×4" needs to be cut using a hand saw to the length of the metal board, cut two pieces of #9 wire (not reusable), hold the 2"×4" on the side of the metal board (one hand), while trying to get the #9 wire through the hole of the metal board to tighten the 2"×4" with the piece of #9 wire by twisting wire with pliers. Hoping it doesn't break, if it breaks the builder will have to repeat the process again jeopardizing fellow co-workers near or below the area if the 2"×4" slips off his hand and falls. This is a typical process when the builder is working alone. If being helped, this process is a little faster, but it doubles the cost of labor.

Once the 2"×4" is in place, a piece of plywood is nailed down from the top of the boards using four nails, two nails on each end of the plywood into the 2"×4". This is a process that takes up to 30 minutes in a non-congested area. In extremely congested areas, it may even take up to 2 or 3 hours depending on the weather or other factors such as the length of the scaffold deck and skill of the person doing the job.

When a company gets a contract to build scaffolds in some units with corrosive liquids or radiation, all lumber that goes into these areas needs to be decontaminated and cannot be removed from the area until it is no longer good for use. After that, the lumber gets transported to another area where they are properly disposed of by burning it or dissolving it in other chemicals that ends up burning into the atmosphere.

There have been scenarios where people have built scaffolding around uninsulated piping. When plywood has been installed too close to the holes caused by the pipe passing through the scaffold deck, the pipe is at ambient temperature when built. But when the pipe becomes in service it can reach temperatures of up to 200° F. Plywood or 2"×4" too close to the pipe have been known to catch fire, resulting in property and sometimes even equipment damage, resulting in millions of dollars' worth of damage. Thus, a need exists to build a safe and more cost-effective scaffold deck in highly congested areas.

It is an objective of the present invention to provide a solution to the aforementioned problems. The present invention is a set of scaffold seal plates that can easily be used to fully close a scaffold deck in a congested area. The purpose of the present invention is to accelerate time on installation and eliminate the need of plywood on open holes in scaffold decks by 90% faster installation, provide safer scaffold platforms with open holes, minimize the use of lumber for construction of scaffold decks in congested areas, while providing safer scaffold decks built around hot areas and safer installation. The present invention also lowers the cost on consumables such as #9 wire and nails. With its easy installation process, the amount of people needed to seal open holes is reduced. The user only needs a scaffold ratchet that every scaffold builder carries in their tool belt.

The present invention comprises two types of aluminum plates, hereinafter referred to as "seal plate A" and "seal plate B." Both types of plates can be manufactured to any size, ranging from 1 foot to 50 feet in length or diameter. Brackets are used to secure seal plate A in place, thereby preventing it from shifting around during normal use. After building the scaffold frame and laying down metal boards, the builder will need to take seal plate A and lay it down over the opening and tighten both brackets using a scaffold ratchet. The bracket will lock under the metal board and or horizontal bar to secure Seal Plate A.

Seal Plate B will only be used if there is an object that will pass through the scaffold deck leaving an opening when applying seal plate A in between. When applying seal plate B, the builder will need to loosen up 2 bolts, so seal plate B can slide to fit the size of the object passing through scaffold deck. Then, the builder will lay seal plate B down on the top of Seal Plate A. Magnets will make seal plate B stick in place to prevent movement. To finish installation, the builder will tighten up the bolts on seal plate B plate to secure it in place.

There are many advantages to using the present invention instead of traditional methods. Unlike lumber, the seal plates can be decontaminated using baking soda or any other chemicals that nuclear plants and refineries use to decontaminate scaffolding that is used in these areas, without losing any money on lumber or creating an additional cost to the client. These plates can be re-used over and over again, even if they get exposed to heat, water or any chemical. Thus, seal plates will conserve its ability to cover a hole on a scaffold deck while providing more and better protection than plywood sheets.

SUMMARY

It is an aim of the present invention to provide an improved scaffold seal cover that is reusable, cost effective, and easier to install. The present invention is a set of scaffold seal plates that are quick to install and fully cover all floor openings on a scaffold deck. Depending on the type of protruding structure encountered, the present invention can have multiple configurations to cover any floor opening.

For a protruding structure with linear flat sides, the present invention can be configured to have at least one seal plate A and at least one bracket. In one configuration, wherein the protruding structure is situated near the center of the scaffold deck, the present invention comprises multiple seal plates A and multiple brackets. In this configuration, one of the seal plates A is placed over the floor opening, wherein one side of the plate A is abutted up against the left-side of the protruding structure. A second seal plate A is placed on the opposite end, wherein one side of the second plate A is abutted up against the right-side of the protruding structure. The remaining set of seal plates A are abutted up against each other, spanning the entire length of the floor opening, leaving little to no gap around the protruding structure.

Each of the seal plates A are removably attached to structural support members below the top surface of the scaffold deck using brackets. Although this process can be performed in multiple ways, it is most efficient to pre-install (i.e., loosely attach) the brackets to each plate A before attempting to install the seal plates A to the scaffold deck. Specifically, a bolt and washer are used to loosely attach the top end of the bracket to a slotted opening on the seal plate A. This allows the user to easily slide the top of the bracket across the slotted opening and connect the bottom of the bracket to a structural support, all without having to reach underneath and hold the bracket in place.

For a protruding structure having non-linear sides (e.g., pipe), the present invention can be configured to further include a pair of seal plates B in addition to seal plate A. The pair of seal plates B are mechanically joined together to form an adjustable closeout. In other words, the pair of plates B slide in and out, forming an adjustable pair of jaws. The pair of jaws can be widened or narrowed to match the outer shape of the protruding structure. After making the proper adjustment, the user can then place the adjustable closeout on top of the seal plate A, and then slide the pair of jaws into the protruding structure. Preferably, both of the plates B are made from a magnetic material, which magnetically attaches to the seal plates A.

Thus, the combination of the seal plates A and the adjustable closeouts help ensure that all floor openings on the scaffold deck are fully covered. Securing all of the seal plates to the scaffold deck helps prevent the seal plates from shifting around caused by lateral impacts (e.g., kicks or bumps) as the user walks around the scaffold deck.

DETAIL DESCRIPTIONS OF THE INVENTION

All illustrations of the drawings are for the purpose of describing selected versions of the present invention and are not intended to limit the scope of the present invention.

In reference to FIGS. 1-19, the present invention is a seal plate assembly 1 for use on scaffold decks. When a scaffold builder encounters a pipe, metal structure, or any object that passes through a scaffold, it is necessary to install a walking platform (e.g., metal floorboards) around the protruding structure 91, which will allow contractors to continue their work. But even with the walking platform, it is common practice to cover all remaining floor openings to prevent an avoidable accident. Oftentimes, scaffold builders use plywood to cover these openings. However, this method is inefficient because it is labor intensive and, in many cases, the plywood must be destroyed and replaced after each use. Thus, it is an aim of the present invention to provide an improved scaffold seal cover that is reusable, cost effective, and easier to install.

Hereinafter, the term "protruding structure" refers to any fixed object (e.g., pipe, beam, air duct) that traverses through a floor opening of the scaffold deck. The term "floor opening" refers to any exposed open spaces or gaps (large or small) on the top surface of the scaffold deck that can be hazardous to worker safety.

Figure 1:
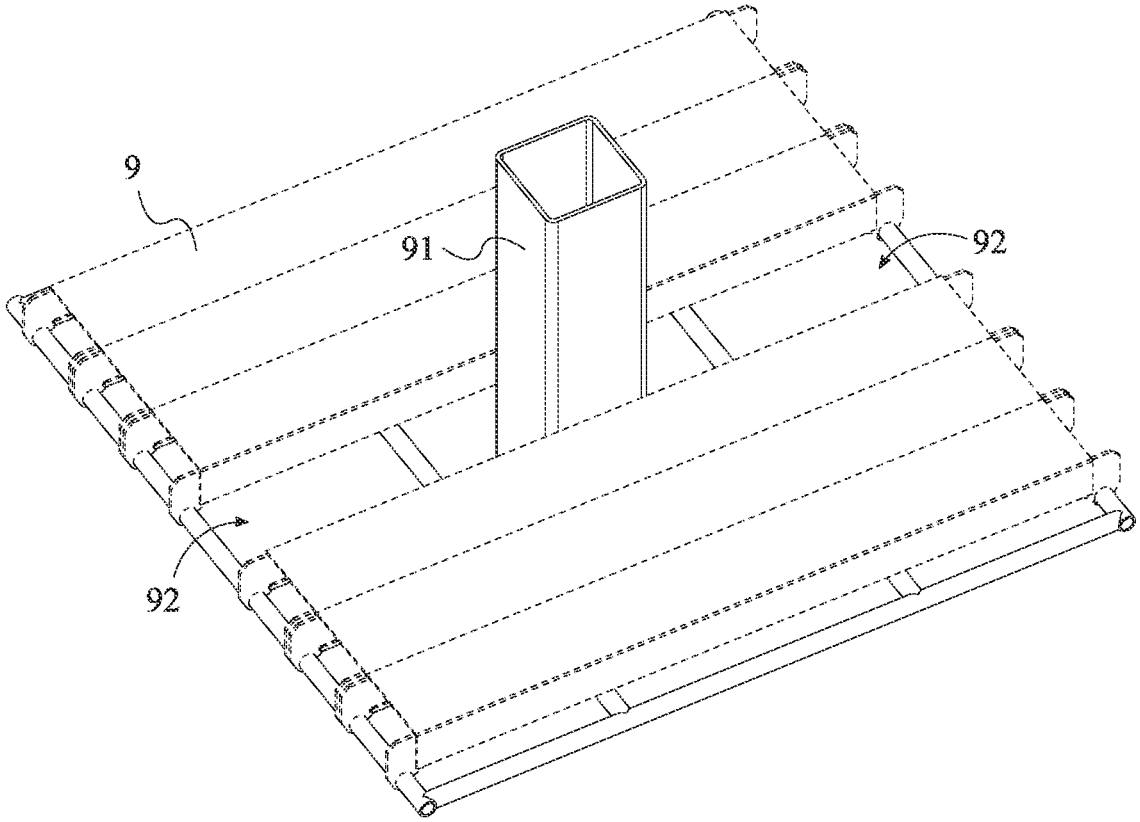
FIG. 1 is a top-front perspective view of a scaffold deck.
Figure 2:
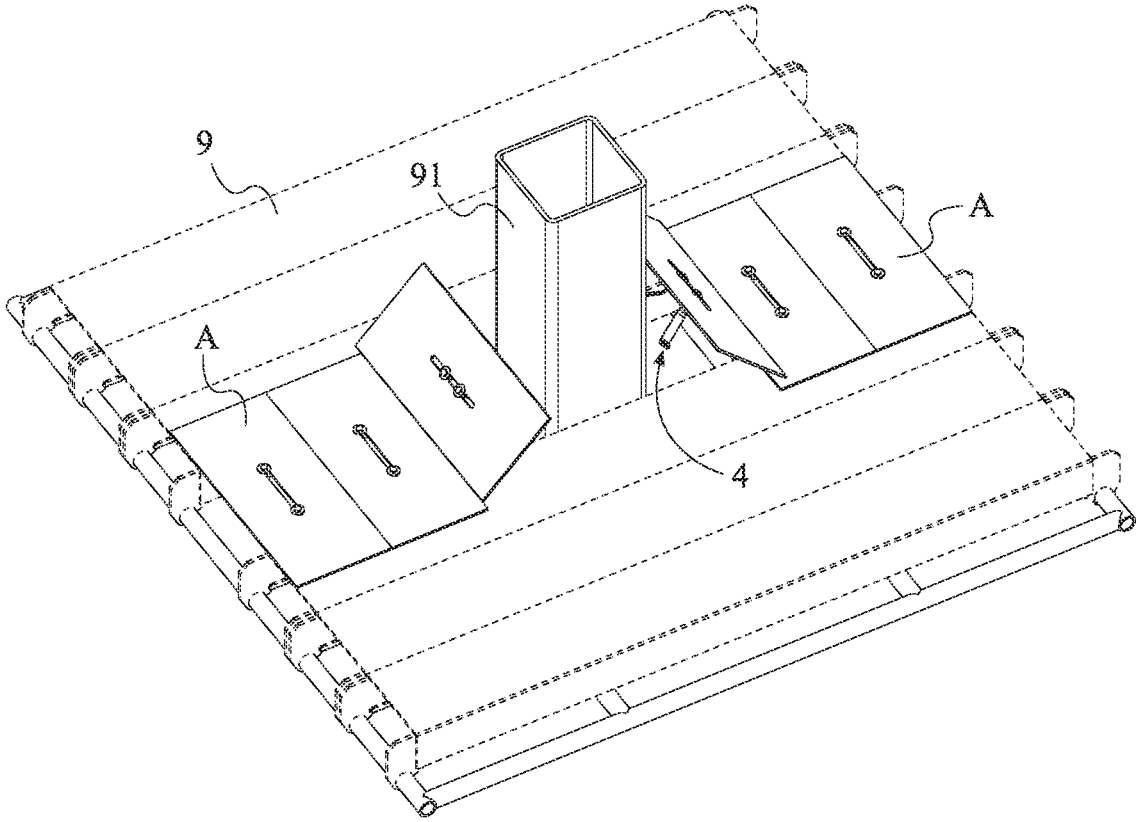
FIG. 2 is a top-front perspective view of the present invention shown partially installed on the scaffold deck.
Figure 3:
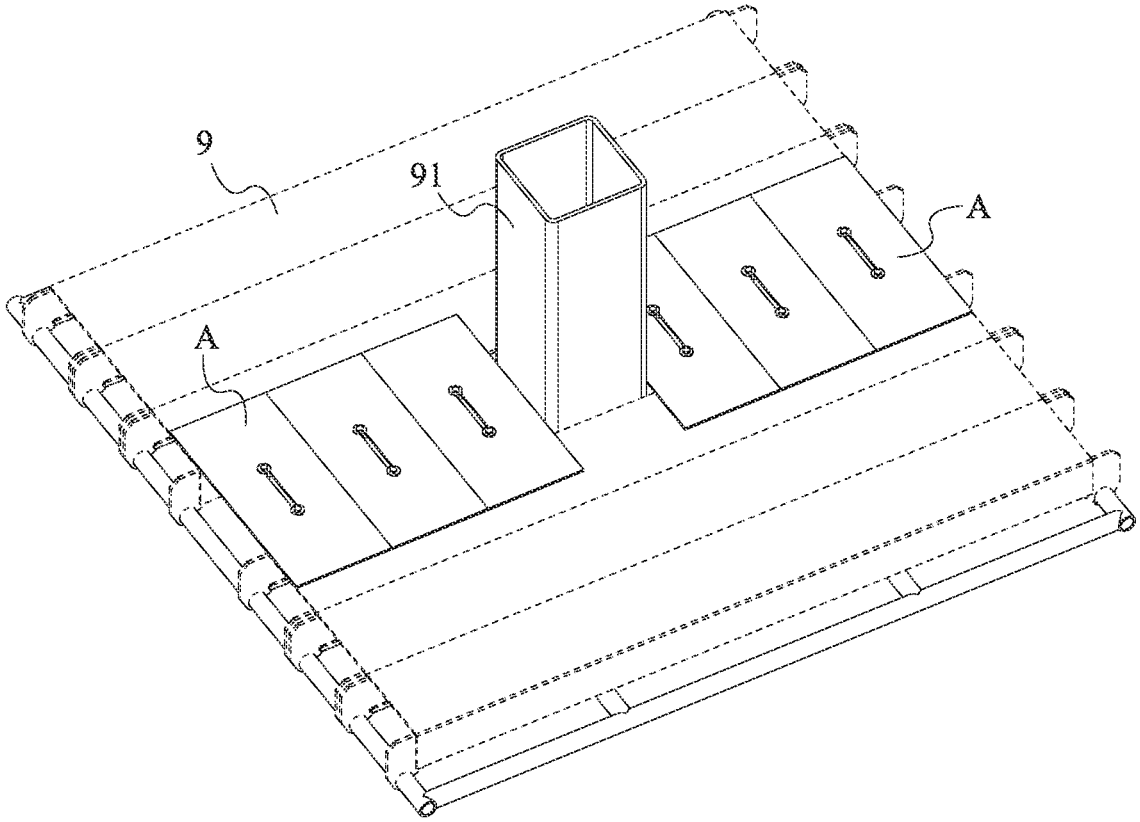
FIG. 3 is a top-front perspective view of the present invention shown fully installed on the scaffold deck.
Figure 4:
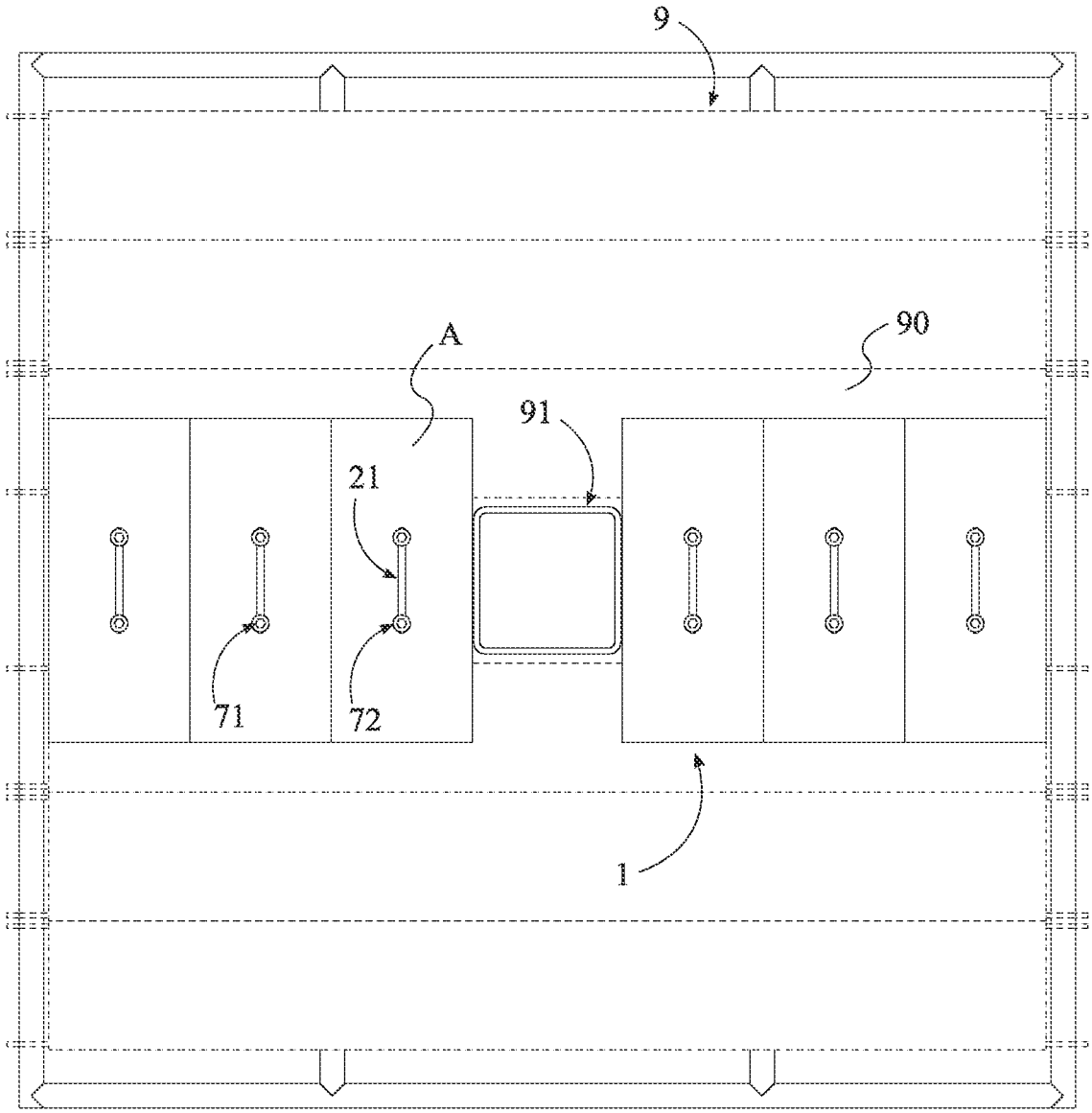
FIG. 4 is a top plan view of the present invention.
Figure 5:
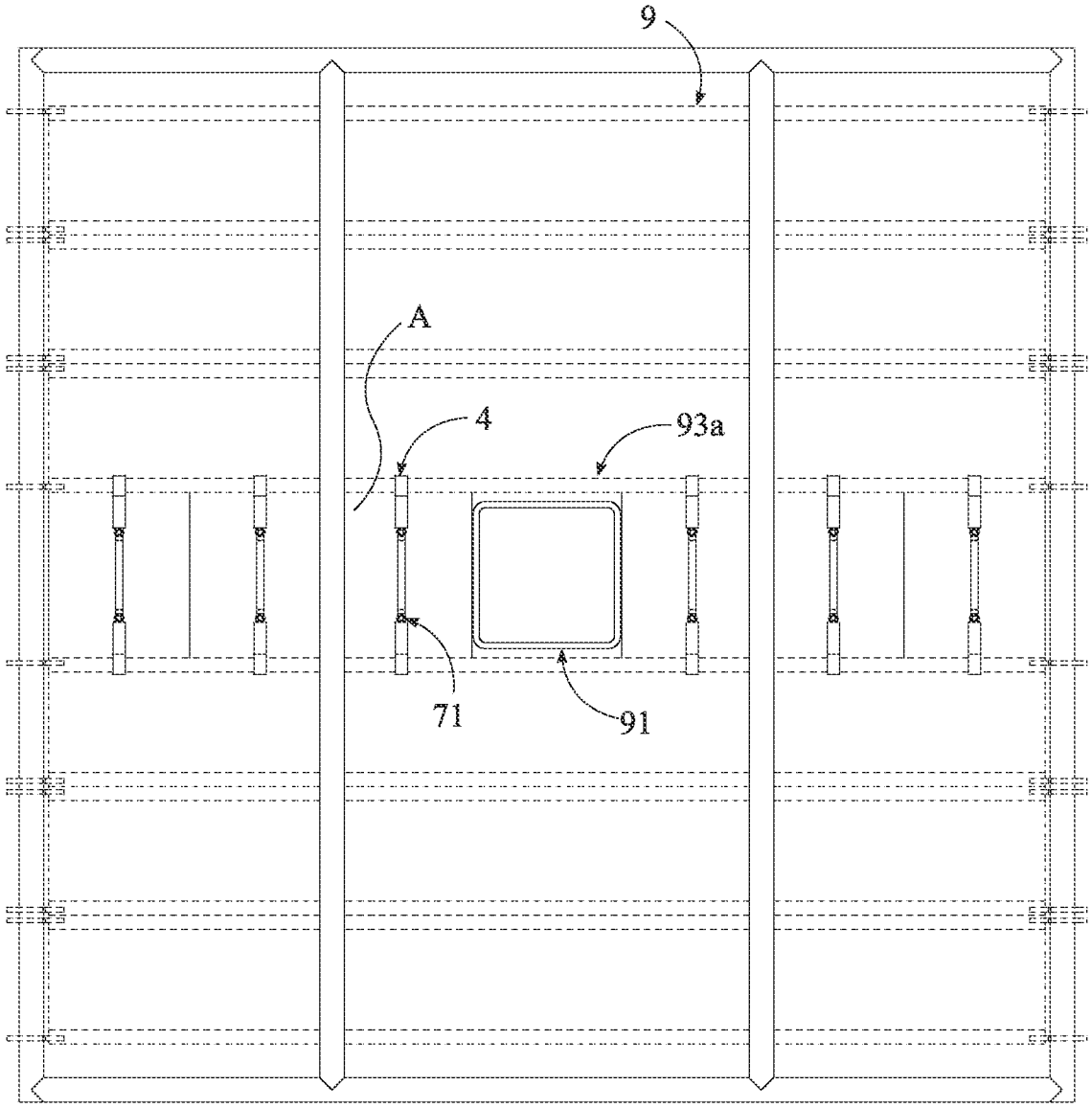
FIG. 5 is a bottom plan view of the present invention.

Depending on the type of protruding structure 91, the present invention can have multiple configurations to cover any floor opening 92 on the scaffold deck 9. In reference to FIGS. 1-9, for a protruding structure 91 having linear sides, the present invention comprises at least one plate A and at least one bracket 4. In a preferred embodiment, as can be seen in FIG. 2, the present invention comprises a plurality of plates A and a plurality of brackets 4. In this embodiment, each plate A is disposed on a top surface 90 of the scaffold deck 9 and positioned over the floor opening 92, wherein a substantial portion of each plate A overlaps the floor opening 92 on both sides. Collectively, the plurality of plates A span the entire length of the floor opening 92, leaving a minimal gap around the protruding structure 91. Each of the plates A are abutted up against each other to avoid any significant gaps between two adjacent plates A.

Each of the plates A are detachably mounted to the scaffold deck 9, via the at least one bracket 4. Although there are multiple ways to perform this task, it is preferred to pre-install (i.e., loosely attach) the at least one bracket 4 to the at least one plate A, prior to positioning the at least one plate A over the floor opening 92. As best seen in FIG. 2, this arrangement allows the user to easily slide the top end of the bracket 4 across the slotted aperture 21 and connect the bottom end of the bracket 4 to a structural support member on the underside of the scaffold deck 9, all without having to reach underneath and hold the bracket 4 in place. Once firmly attached, the user can tighten down the hardware connecting the top end of the bracket 4 to the plate A, thereby securing the plate A to the scaffold deck 9.

Figure 7:
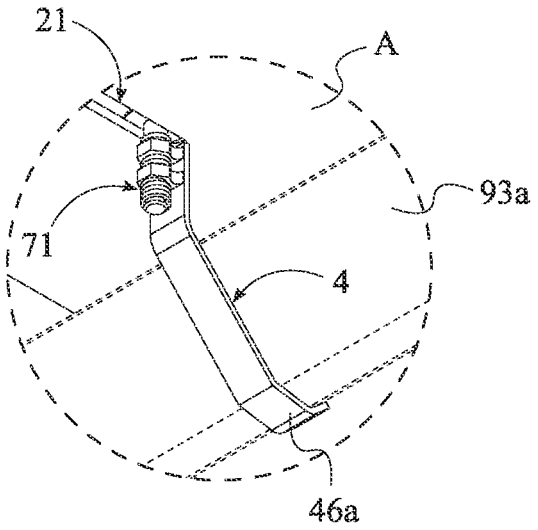
FIG. 7 is a magnified view taken from FIG. 6, showing the bracket installation.
Figure 6:
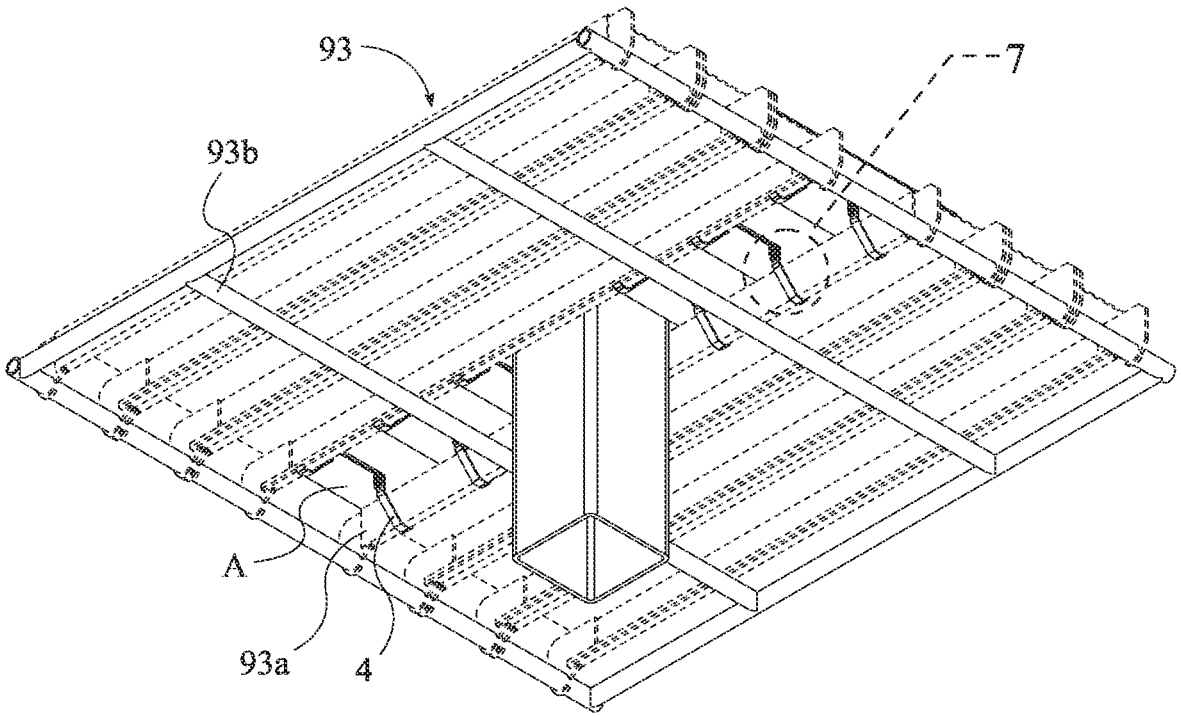
FIG. 6 is a bottom-front perspective view of the present invention.
Figure 9:
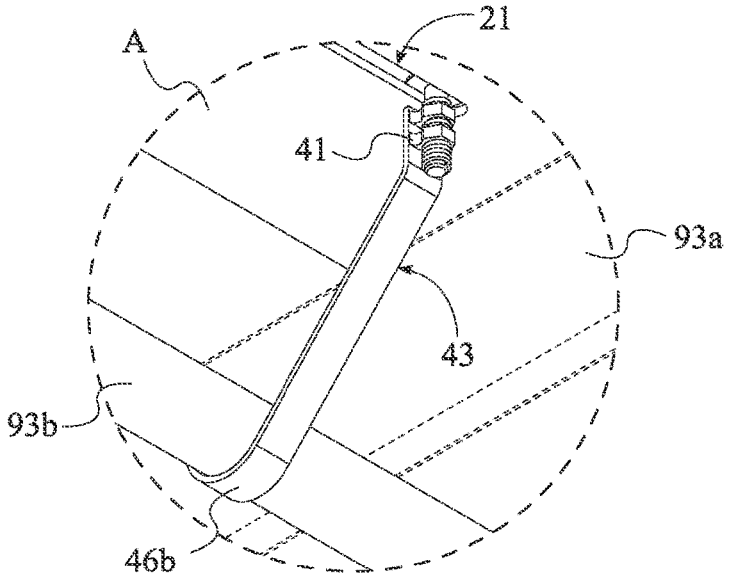
FIG. 9 is a magnified view taken from FIG. 8, showing the bracket installation.
Figure 8:
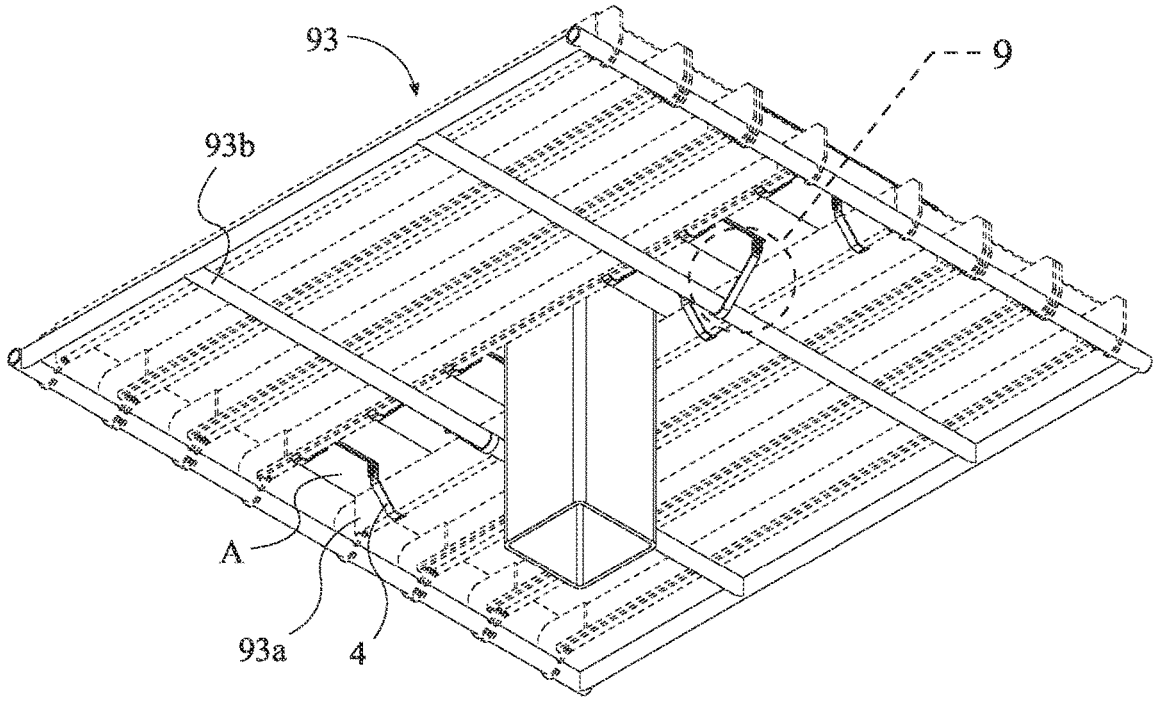
FIG. 8 is a bottom-front perspective view of the present invention, in accordance with another embodiment.

To secure the at least one bracket 4 to the at least one plate A, the top end 41 of the at least one bracket 4 is secured to the slotted aperture 21 of the at least one plate A, via a bolt 71 and a washer 72. As best seen in FIG. 7 and FIG. 9, the bolt 71 is first inserted through the washer 72, then through the slotted aperture 21 on the plate A, and fastened to the top end 41 of the at least one bracket 4. To secure the at least one bracket 4 to the scaffold deck 9, the bottom end 44 of the at least one bracket 4 is secured to a structural support member 93 below the top surface 90 of the scaffold deck 9. More specifically, as seen in FIG. 7, the bottom end 44 of the at least one bracket 4 is latched on to a floorboard structure 93*a* nearest to the at least one plate A. In another embodiment, as seen in FIG. 9, the bottom end 44 of the at least one bracket 4 is latched on to a tubular frame 93*b*.

Figure 13:
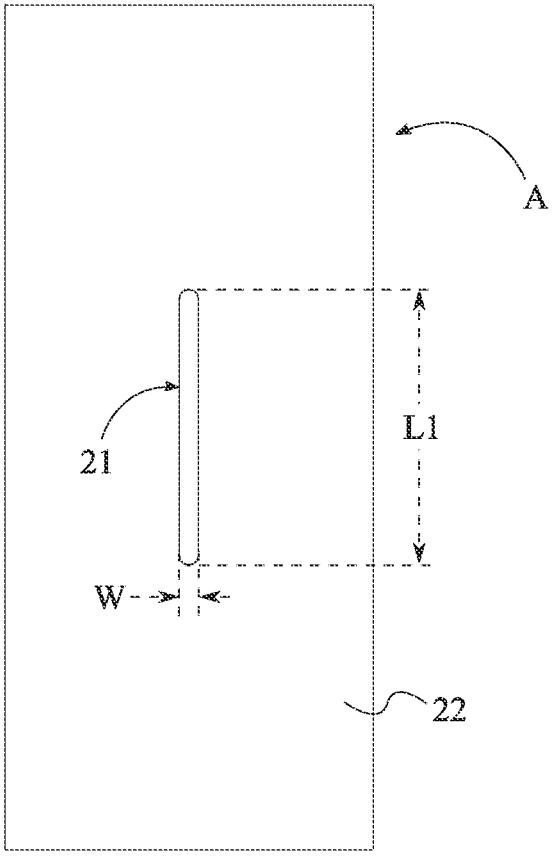
FIG. 13 is a top plan view of the plate A of the present invention.

As can be seen in FIG. 13, each of the at least one plates A is rectilinear in shape. The at least one plate A further comprises a slotted aperture 21 disposed on a top surface 22 of the plate A. In particular, the slotted aperture 21 is centered with the plate A, and traverses longitudinally. The slotted aperture 21 has a first length L1 defined by the arrangement of the at least one bracket 4. More specifically, the first length L1 is sufficient to allow the at least one bracket 4 to reach and connect to a structural support member 93 of the scaffold deck 9. Furthermore, the slotted aperture 21 has a width W that is defined by the size of the bolt 71. When the at least one plate A is properly installed, the at least one bracket 4 helps prevent the plate A from shifting caused by lateral impacts (e.g., kicks or bumps) as the user walks around the scaffold deck 9. Preferably, the plate A is made out of high-strength aluminum. However, the material of Plate A is not limited, and can be made of any suitable material based on design, user, and/or manufacturing requirements. Moreover, the thickness of the plate A is not limited, and can be of any suitable thickness based on design, user, and/or manufacturing requirements. Each plate A can be manufactured to any size, ranging from 1 foot to 50 feet in length or diameter, depending on user requirements.

Figure 16:
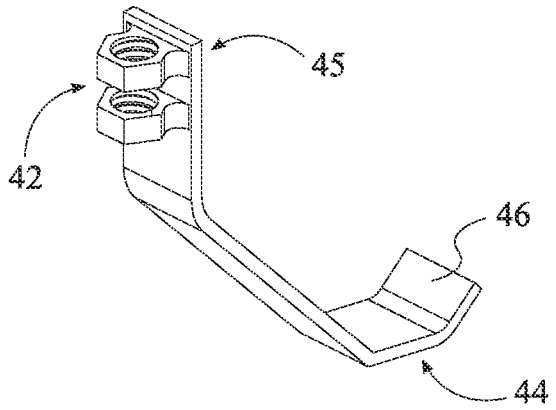
FIG. 16 is a perspective view of the bracket of the present invention.
Figure 17:
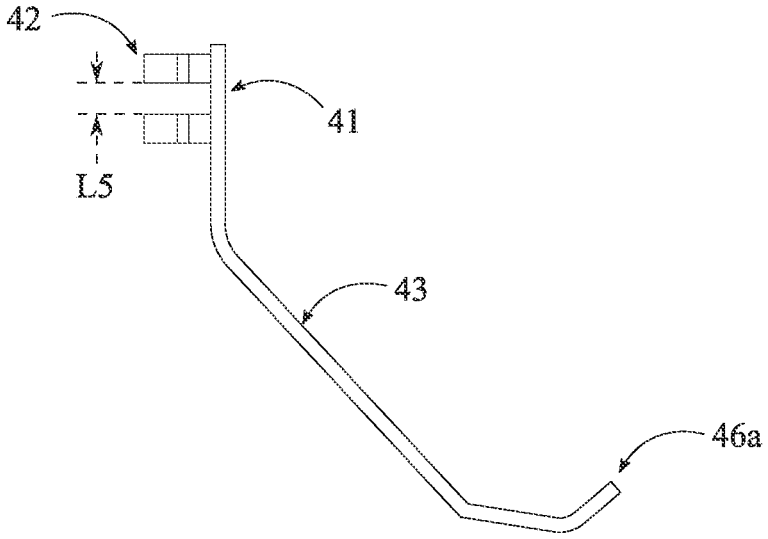
FIG. 17 is a right-side elevational view of the bracket of the present invention.
Figure 18:
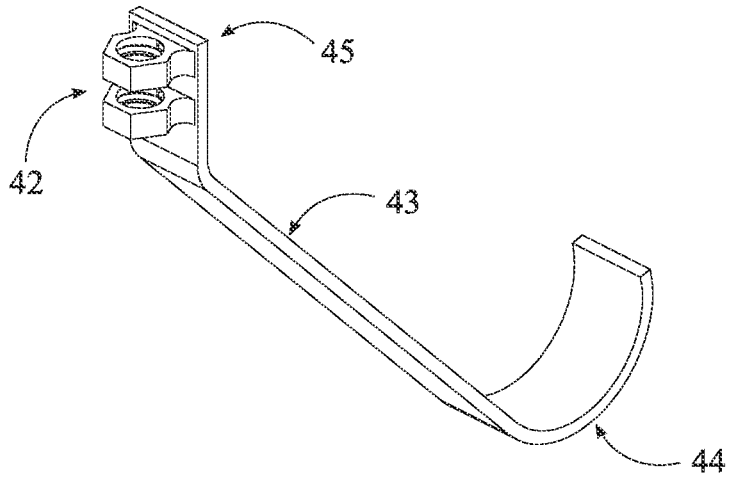
FIG. 18 is a perspective view of the bracket of the present invention, in accordance with another embodiment.
Figure 19:
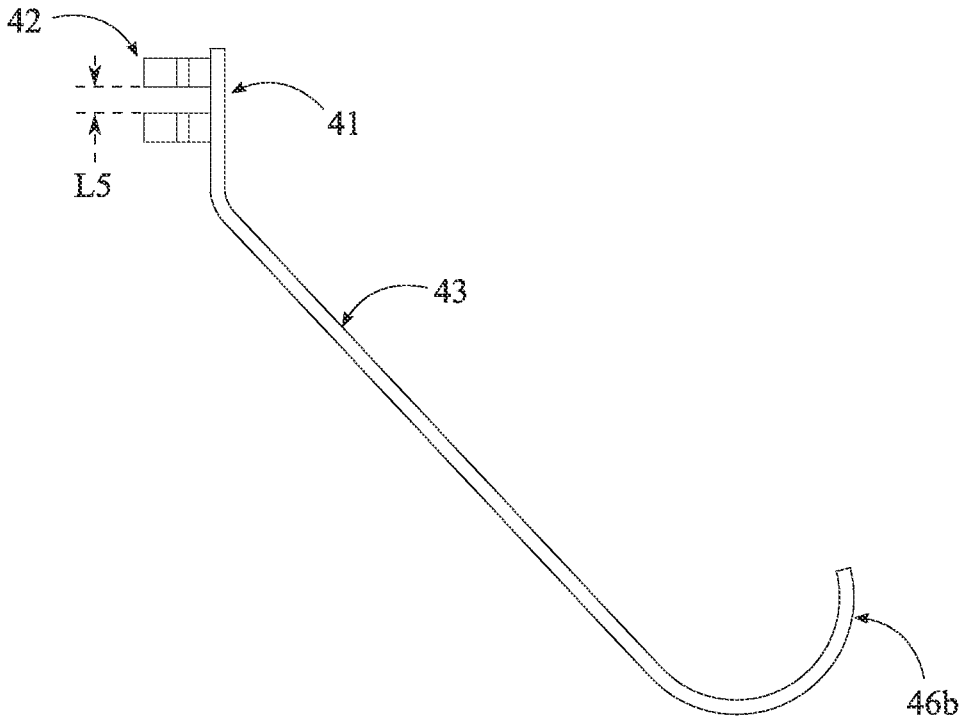
FIG. 19 is a right-side elevational view of the bracket of the present invention, in accordance with another embodiment.

As can be seen in FIGS. 16-19, the at least one bracket 4 can take the form of any profile shape and size as required for attaching the plate A to the scaffold deck 9. The at least one bracket 4 further comprises a top end 41, a spanning portion 43, and a bottom end 44. The spanning portion 43 connects the top end 41 to the bottom end 44. The top end 41 further comprises an upright flange 45 and a pair of threaded mounting posts 42. The pair of threaded mounting posts 42 are terminally connected to the upright flange 45, extending outward and perpendicular to the upright flange 45. Each of the pair of threaded mounting posts 42 are axially aligned and offset from each other by a predefined spacing L5. This arrangement enables the bolt 71 to be inserted through the slotted aperture 21 of the plate A and secured to the pair of threaded mounting posts 42 on the top end 41 of the bracket 4. The spanning portion 43 is terminally connected to the top end 41, extending outward to the bottom end 44. The bottom end 44 comprises a retainer hook 46 adapted to removably attach to the desired structural support member 93 below the top surface 90 of the scaffold deck 9. In the preferred embodiment, as seen in FIGS. 16-17, the retainer hook 46 is in the form of an upward facing lip 46*a*. The upward facing lip 46*a* is contoured to latch onto the backside floorboard structure 93*a*, as illustrated in FIG. 7. In another embodiment, as seen in FIGS. 18-19, the retainer hook 46 is in the form of a circular lip 46*b*. The circular lip 46*b* is contoured to latch onto the tubular frame 93*b* of the scaffold deck 9, as illustrated in FIG. 9. Preferably, the at least one bracket 4 is constructed from a single unitary piece and made out of high-strength aluminum. However, the material of the at least one bracket 4 is not limited, and can be made of any suitable material based on design, user, and/or manufacturing requirements.

Figure 10:
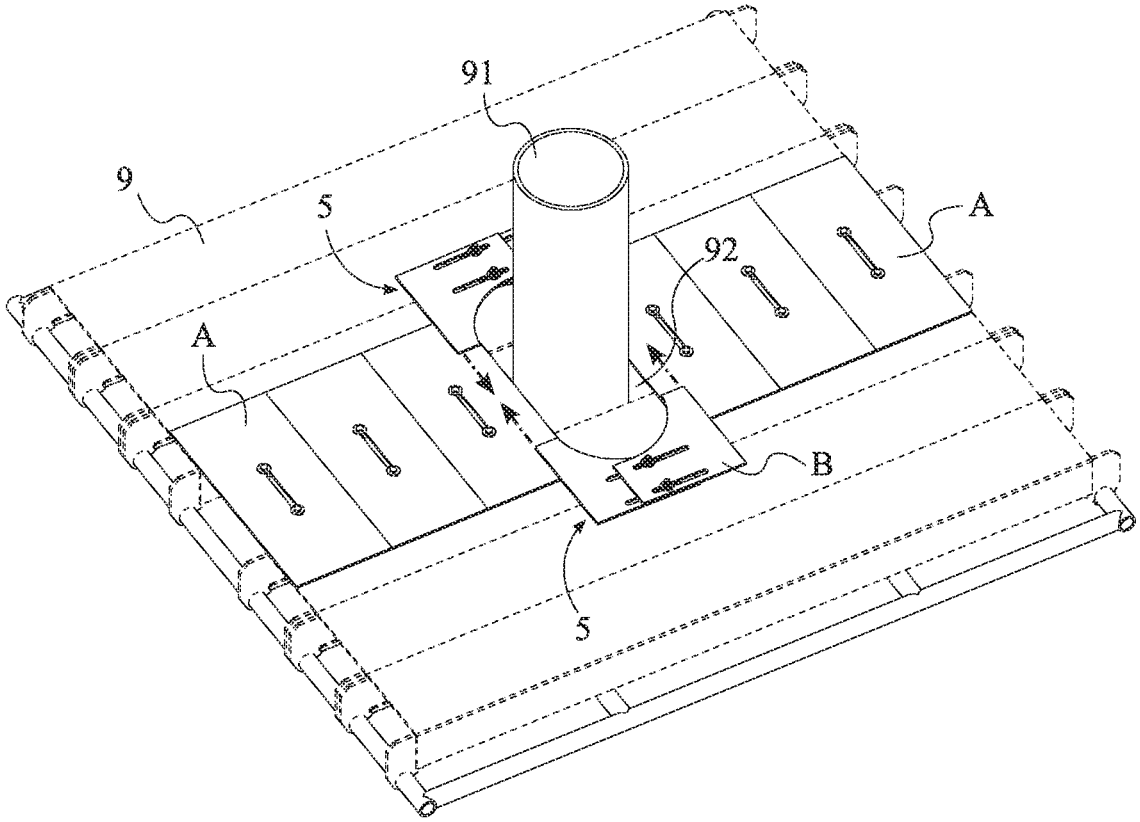
FIG. 10 is a top-front perspective view of the present invention, in accordance with another embodiment.
Figure 11:
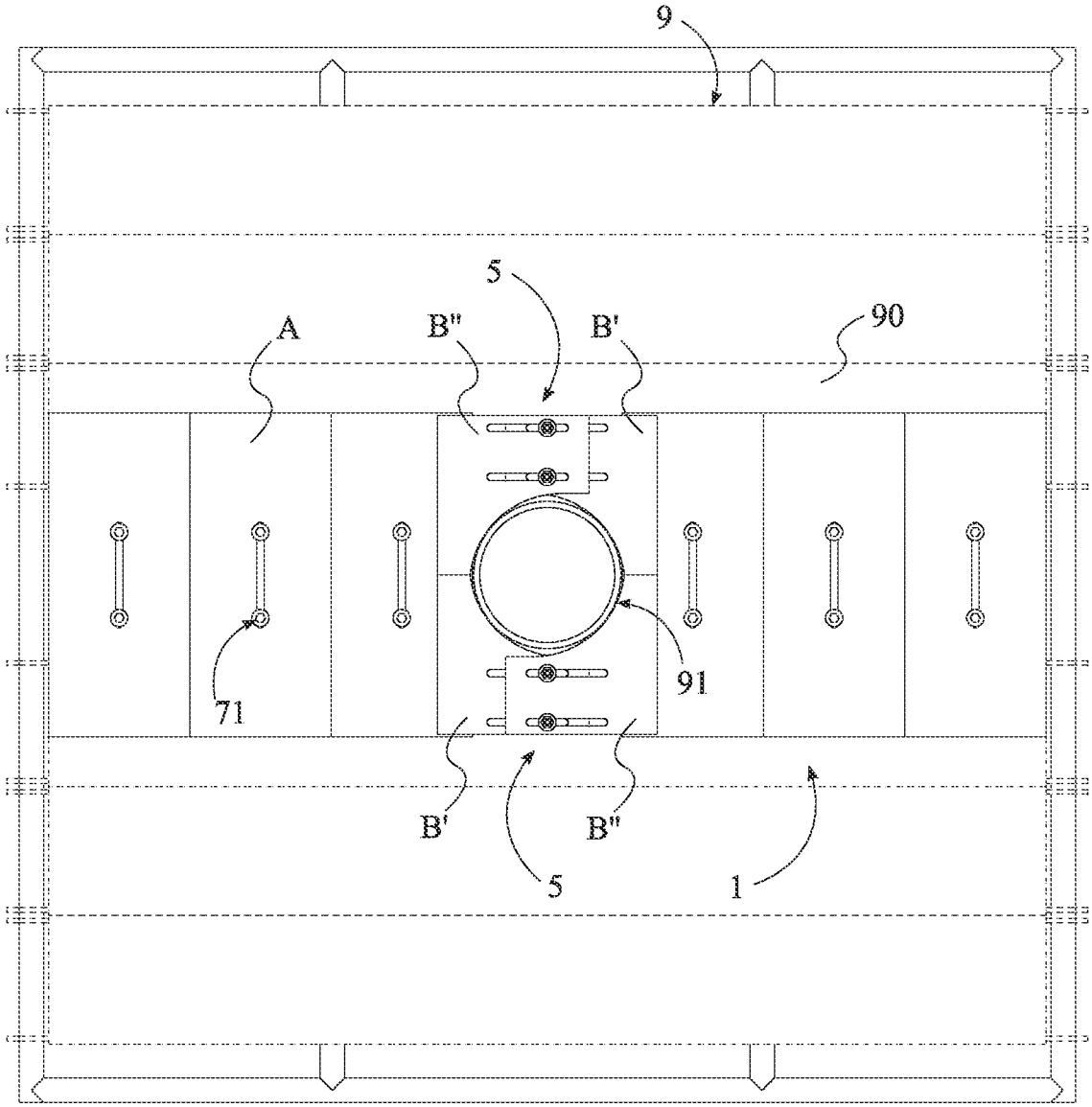
FIG. 11 is a top plan view of the present invention, in accordance with another embodiment.
Figure 12:
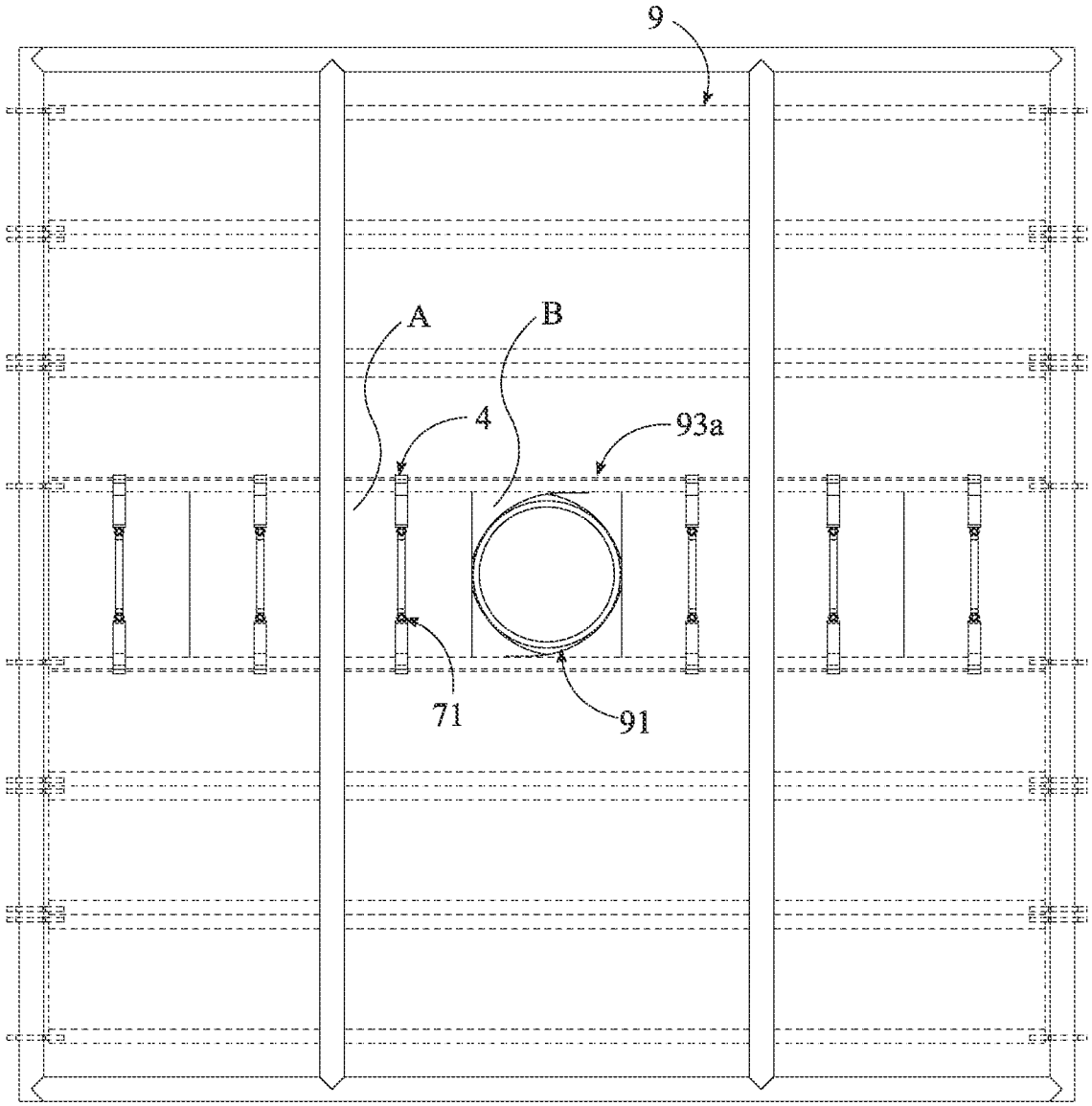
FIG. 12 is a bottom plan view of the present invention, in accordance with another embodiment.

FIGS. 10-12 illustrate another embodiment for a protruding structure 91 having non-linear sides (e.g., pipe). In this embodiment, the present invention can be further configured to close out any remaining floor openings 92 around the protruding structure 91 on the scaffold deck 9. Specifically, in addition to the at least one plate A and the at least one bracket 4, the present invention further comprises at least one adjustable closeout 5. The at least one adjustable closeout 5 has a pair of jaws 51 capable of surrounding at least half the perimeter of the protruding structure 91, thereby covering the floor opening 92 formed between the protruding structure 91 and the at least one plate A. As best seen in FIGS. 10-11, two adjustable closeouts 5 can be positioned to surround the entire perimeter of the protruding structure 91. In this arrangement, each adjustable closeout 5 is positioned on the top surface 22 of the at least one plate A, wherein the pair of jaws 51 can be adjusted to slidably engage with the protruding structure 91. In other words, the pair of jaws 51 can be widened or narrowed to substantially match the exterior shape of the protruding structure 91. The user can then slide the adjustable closeout 5 inward until the pair of jaws 51 are abutted up against the protruding structure 91. Once installed, the adjustable closeout 5 has the added benefit of increasing worker safety, as it eliminates the possibility of a tool falling through a small floor opening 92 and causing injury to a worker directly below.

Figure 15:
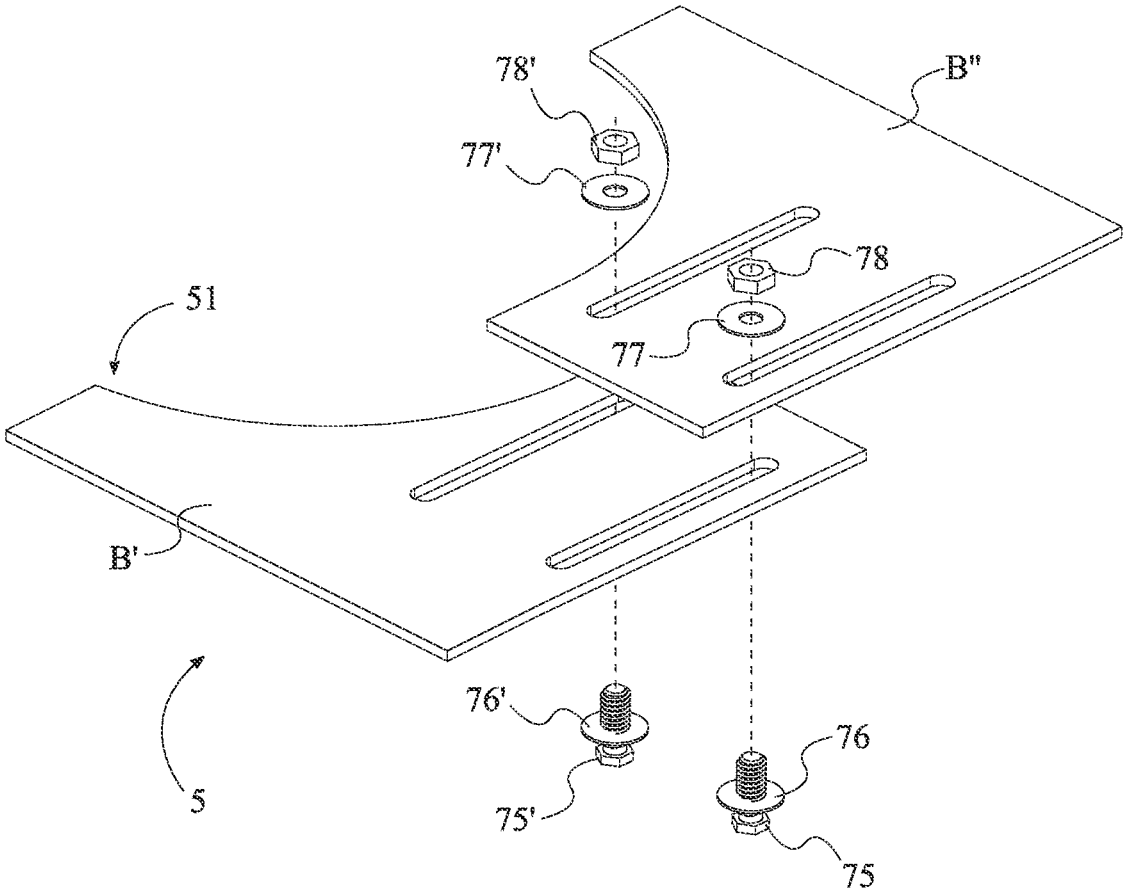
FIG. 15 is a top-front perspective exploded view of the adjustable closeout of the present invention.

As can be seen in FIG. 15, the at least one adjustable closeout 5 further comprises a first plate B' and a second plate B". Both of the plates B are opposingly aligned, wherein the first plate B' is positioned directly below the second plate B". Both plates B are fastened to each other via hardware positioned over a pair of slotted apertures 36 and 37. In particular, a bolt 75 first extends through a first washer 76, then through a lower slotted aperture 36 of both the first plate B' and the second plate B". The bolt 75 finally extends through a second washer 77 and is secured by a nut 78. Similarly, a bolt 75' first extends through a first washer 76', then through an upper slotted aperture 37 of both the first plate B' and the second plate B". The bolt 75' finally extends through a second washer 77' and is secured by a nut 78'. In this arrangement, the bolts 75 and 75' slidably engage with the lower slotted aperture 36 and the upper slotted aperture 37, respectively. This allows the first plate B' to slide laterally, relative to the second plate B". In turn, this allows the pair of jaws 51 to widen and narrow.

Figure 14:
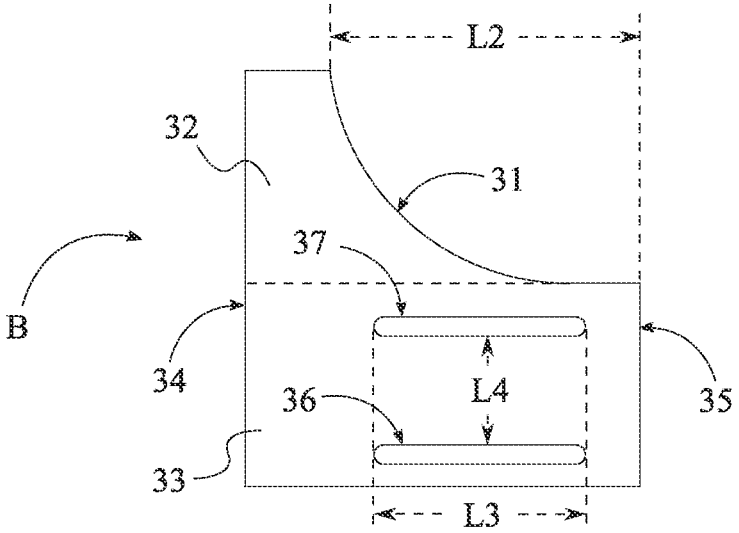
FIG. 14 is a top plan view of the plate B of the present invention.

As can be seen in FIG. 14, the plate B comprises a cutout 31, a lower slotted aperture 36, and an upper slotted aperture 37. The cutout 31 is disposed on an upper surface 32 of the plate B, extending transversely from a right side 35 towards a left side 34, at a predefined second length L2. A substantial portion of the left side 34 remains uncut to allow the plate B to overlap the plate A during installation. The shape of the cutout 31 is defined by the protruding structure 91. More specifically, the cutout 31 is shaped to match a quarter section of the exterior shape of the protruding structure 91. By way of example, as illustrated in in FIG. 14, the cutout 31 is in the shape of an arc. The arc shape corresponds with a tube-shaped protruding structure 91, such that the plate B covers roughly a quarter section of the floor opening 92 surrounding the protruding structure 91. When combined with a second plate B", as illustrated in FIG. 15, the arrangement of the cutouts 31 of both the first plate B' and the second plate B" forms the shape of the pair of jaws 51.

In order to adjust the size of the pair of jaws 51, both the lower slotted aperture 36 and the upper slotted aperture 37 are disposed on a lower surface 33 of the plate B (i.e., below the cutout 31). As seen in FIG. 14, the lower slotted aperture 36 is positioned parallel with the upper slotted aperture 37, spaced apart by a predefined gap L4. Both the lower slotted aperture 36 and the upper slotted aperture 37 traverse laterally at a predefined third length L3. Specifically, the third length L3 is defined by the size of the protruding structure 91, such that the pair of jaws 51 are capable of slidably engaging with the protruding structure 91. Preferably, the plate B is made out of high-strength aluminum. In another embodiment, the plate B is made out of a material that produces a magnetic field, capable of magnetically attaching to the at least one plate A. This arrangement prevents the adjustable closeout 5 from shifting caused by lateral impacts (e.g., kicks or bumps) as the user walks around the scaffold deck 9. The size and thickness of the plate B is not limited, and can be of any suitable size and thickness based on design, user, and/or manufacturing requirements.

Although the invention has been explained in relation to its preferred embodiment, it is to be understood that many other possible modifications and variations can be made without departing from the spirit and scope of the invention.

What is claimed is:

1. A plate assembly for covering floor openings on a scaffold deck, the plate assembly comprising:

at least one plate A;

at least one bracket;

the at least one plate A comprising a slotted aperture;

the slotted aperture being disposed on a top surface of the plate A;

the at least one plate A being positioned on top of a scaffold deck;

the at least one plate A covering a floor opening of the scaffold deck;

the at least one plate A being detachably mounted to the scaffold deck, via the at least one bracket;

the at least one bracket comprising a top end, a spanning portion, and a bottom end;

the spanning portion extending from the top end to the bottom end;

the top end being adapted to slidably engage with the slotted aperture of the at least one plate A;

the bottom end being adapted to detachably connect to the scaffold deck;

the top end further comprising an upright flange and at least one threaded mounting post;

the at least one threaded mounting post extending outward, perpendicular to the upright flange; and a bolt being inserted through a washer, through the slotted aperture of the at least one plate A, and into the at least one threaded mounting post.

2. The plate assembly as claimed in claim 1 comprising:

the bottom end further comprising a retainer hook; and the retainer hook being detachably connected to a structural support member of the scaffold deck.

3. The plate assembly as claimed in claim 2 comprising:

the retainer hook being in the shape of an upward facing lip; and the structural support member being a floorboard structure.

4. The plate assembly as claimed in claim 2 comprising:

the retainer hook being in the shape of a circular lip; and the structural support member being a tubular frame.

5. The plate assembly as claimed in claim 1 comprising:

at least one adjustable closeout;

the at least one adjustable closeout comprising a first plate B, a second plate B, at least one bolt, and at least one nut;

the first plate B and the second plate B each comprising a cutout and at least one slotted aperture;

the cutout being disposed on an upper surface of each of the first and second plates B;

the at least one slotted aperture being disposed on a lower surface of each of the first and second plates B, traversing laterally;

the first plate B being opposingly aligned with the second plate B;

the first plate B being slidably connected to the second plate B;

the at least one bolt being inserted through the at least one slotted aperture of the first plate B, through the at least one slotted aperture of the second plate B, and secured via the at least one nut;

a pair of jaws being formed via the cutout of the first plate B and the cutout of the second plate B;

the at least one adjustable closeout being disposed on the top surface of the at least one plate A;

the pair of jaws slidably engaging with a protruding structure; and the at least one adjustable closeout being capable of covering the floor opening between the at least one plate A and the protruding structure.

6. The plate assembly as claimed in claim 5 comprising:

each of the first and second plates B being made out of a material that produces a magnetic field; and the at least one adjustable closeout being magnetically attached to the at least one plate A.

7. The plate assembly as claimed in claim 1, wherein the plate A being rectilinear in shape.

8. A plate assembly for covering floor openings on a scaffold deck, the plate assembly comprising:

at least one plate A;

at least one bracket;

the at least one plate A comprising a slotted aperture;

the slotted aperture being disposed on a top surface of the plate A;

the at least one plate A being positioned on top of a scaffold deck;

the at least one plate A covering a floor opening of the scaffold deck;

the at least one plate A being detachably mounted to the scaffold deck, via the at least one bracket;

the at least one bracket comprising a top end, a spanning portion, and a bottom end;

the spanning portion extending from the top end to the bottom end;

the top end being adapted to slidably engage with the slotted aperture of the at least one plate A;

the bottom end being adapted to detachably connect to the scaffold deck;

the bottom end further comprising a retainer hook;

the retainer hook being detachably connected to a structural support member of the scaffold deck;

the retainer hook being in the shape of an upward facing lip; and the structural support member being a floorboard structure.

9. The plate assembly as claimed in claim 8 comprising:

at least one adjustable closeout;

the at least one adjustable closeout comprising a first plate B, a second plate B, at least one bolt, and at least one nut;

the first plate B and the second plate B each comprising a cutout and at least one slotted aperture;

the cutout being disposed on an upper surface of each of the first and second plates B;

the at least one slotted aperture being disposed on a lower surface of each of the first and second plates B, traversing laterally;

the first plate B being opposingly aligned with the second plate B;

the first plate B being slidably connected to the second plate B;

the at least one bolt being inserted through the at least one slotted aperture of the first plate B, through the at least one slotted aperture of the second plate B, and secured via the at least one nut;

a pair of jaws being formed via the cutout of the first plate B and the cutout of the second plate B;

the at least one adjustable closeout being disposed on the top surface of the at least one plate A;

the pair of jaws slidably engaging with a protruding structure; and the at least one adjustable closeout being capable of covering the floor opening between the at least one plate A and the protruding structure.

10. The plate assembly as claimed in claim 9 comprising:

each of the first and second plates B being made out of a material that produces a magnetic field; and the at least one adjustable closeout being magnetically attached to the at least one plate A.

11. The plate assembly as claimed in claim 8, wherein the plate A being rectilinear in shape.

12. A plate assembly for covering floor openings on a scaffold deck, the plate assembly comprising:

at least one plate A;

at least one bracket;

the at least one plate A comprising a slotted aperture;

the slotted aperture being disposed on a top surface of the plate A;

the at least one plate A being positioned on top of a scaffold deck;

the at least one plate A covering a floor opening of the scaffold deck;

the at least one plate A being detachably mounted to the scaffold deck, via the at least one bracket;

the at least one bracket comprising a top end, a spanning portion, and a bottom end;

the spanning portion extending from the top end to the bottom end;

the top end being adapted to slidably engage with the slotted aperture of the at least one plate A;

the bottom end being adapted to detachably connect to the scaffold deck;

the bottom end further comprising a retainer hook;

the retainer hook being detachably connected to a structural support member of the scaffold deck;

the retainer hook being in the shape of a circular lip; and the structural support member being a tubular frame.

13. The plate assembly as claimed in claim 12 comprising:

at least one adjustable closeout;

the at least one adjustable closeout comprising a first plate B, a second plate B, at least one bolt, and at least one nut;

the first plate B and the second plate B each comprising a cutout and at least one slotted aperture;

the cutout being disposed on an upper surface of each of the first and second plates B;

the at least one slotted aperture being disposed on a lower surface of each of the first and second plates B, traversing laterally;

the first plate B being opposingly aligned with the second plate B;

the first plate B being slidably connected to the second plate B;

the at least one bolt being inserted through the at least one slotted aperture of the first plate B, through the at least one slotted aperture of the second plate B, and secured via the at least one nut;

a pair of jaws being formed via the cutout of the first plate B and the cutout of the second plate B;

the at least one adjustable closeout being disposed on the top surface of the at least one plate A;

the pair of jaws slidably engaging with a protruding structure; and the at least one adjustable closeout being capable of covering the floor opening between the at least one plate A and the protruding structure.

14. The plate assembly as claimed in claim 13 comprising:

each of the first and second plates B being made out of a material that produces a magnetic field; and the at least one adjustable closeout being magnetically attached to the at least one plate A.

* * * * *